US010691062B1

(12) United States Patent
Amann et al.

(10) Patent No.: US 10,691,062 B1
(45) Date of Patent: Jun. 23, 2020

(54) TONER CARTRIDGE HAVING A SPRING FOR MECHANICALLY BIASING A DEVELOPER UNIT RELATIVE TO A PHOTOCONDUCTOR UNIT AND FORMING AN ELECTRICAL PATH TO AN IMAGING COMPONENT

(71) Applicant: LEXMARK INTERNATIONAL, INC., Lexington, KY (US)

(72) Inventors: Mark William Amann, Lexington, KY (US); Brian Lester Boettcher, Versailles, KY (US); Gregory Alan Cavill, Winchester, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 16/295,011

(22) Filed: Mar. 7, 2019

(51) Int. Cl.
*G03G 21/18* (2006.01)
*G03G 15/08* (2006.01)
*G03G 21/16* (2006.01)

(52) U.S. Cl.
CPC ..... *G03G 21/1814* (2013.01); *G03G 15/087* (2013.01); *G03G 21/1647* (2013.01); *G03G 21/1652* (2013.01)

(58) Field of Classification Search
CPC ..... G03G 15/0935; G03G 15/065; G03G 15/0865; G03G 15/0889; G03G 21/1814; G03G 21/1652; G03G 21/1647; G03G 15/087
See application file for complete search history.

(56) References Cited

U.S. PATENT DOCUMENTS

| | | | |
|---|---|---|---|
| 5,758,233 | A | 5/1998 | Coffey et al. |
| 5,768,661 | A | 6/1998 | Coffey et al. |
| 5,802,432 | A | 9/1998 | Coffey et al. |
| 6,249,659 | B1 | 6/2001 | Stickler |
| 7,082,275 | B2 | 7/2006 | Portig et al. |
| 7,643,770 | B2 | 1/2010 | Sato et al. |
| 8,879,953 | B2 | 11/2014 | Amann et al. |
| 8,938,179 | B2 | 1/2015 | Amann et al. |
| 9,046,868 | B2 | 6/2015 | Pezdek et al. |

(Continued)

FOREIGN PATENT DOCUMENTS

JP 06051617 A * 2/1994

*Primary Examiner* — Francis C Gray
(74) *Attorney, Agent, or Firm* — Justin M. Tromp

(57) ABSTRACT

A replaceable unit for use in an electrophotographic image forming device according to one example embodiment includes a photoconductor unit having a rotatable photoconductive drum and a developer unit having a rotatable developer roll that is positioned to supply toner to the photoconductive drum. An electrical contact is positioned to contact a corresponding electrical contact in the image forming device when the replaceable unit is installed in the image forming device. A spring mechanically biases the developer unit relative to the photoconductor unit applying a bias force on the developer roll toward the photoconductive drum. The spring is electrically conductive and forms a portion of an electrical path from the electrical contact of the replaceable unit to an imaging component of the replaceable unit for carrying voltage from the electrical contact of the replaceable unit to the imaging component of the replaceable unit.

17 Claims, 10 Drawing Sheets

(56) References Cited

U.S. PATENT DOCUMENTS

| | | | | |
|---|---|---|---|---|
| 9,261,851 | B2 | 2/2016 | Leemhuis et al. | |
| 9,291,992 | B1 | 3/2016 | Boettcher et al. | |
| 9,360,834 | B1 | 6/2016 | Payne et al. | |
| 9,519,262 | B1 | 12/2016 | Tonges et al. | |
| 9,563,169 | B1 | 2/2017 | Carpenter et al. | |
| 9,851,652 | B2 | 12/2017 | Gilliam et al. | |
| 9,910,403 | B2 | 3/2018 | Amann et al. | |
| 10,073,410 | B1 | 9/2018 | Bacon et al. | |
| 2001/0024581 | A1* | 9/2001 | Miyabe | G03G 15/0935 399/119 |
| 2005/0201772 | A1* | 9/2005 | Ishii | G03G 15/065 399/90 |
| 2005/0220476 | A1* | 10/2005 | Kakitani | G03G 15/80 399/90 |
| 2009/0203233 | A1 | 8/2009 | Gayne et al. | |
| 2017/0269546 | A1* | 9/2017 | Yokoi | G03G 21/1814 |
| 2018/0150024 | A1* | 5/2018 | Takahashi | G03G 21/1857 |
| 2018/0284689 | A1* | 10/2018 | Shimizu | G03G 21/1676 |
| 2018/0284690 | A1* | 10/2018 | Mizutani | G03G 15/0865 |

* cited by examiner

TONER CARTRIDGE HAVING A SPRING FOR MECHANICALLY BIASING A DEVELOPER UNIT RELATIVE TO A PHOTOCONDUCTOR UNIT AND FORMING AN ELECTRICAL PATH TO AN IMAGING COMPONENT

CROSS REFERENCES TO RELATED APPLICATIONS

None.

BACKGROUND

1. Field of the Disclosure

The present disclosure relates generally to image forming devices and more particularly to a toner cartridge having a spring for mechanically biasing a developer unit relative to a photoconductor unit and forming an electrical path to an imaging component.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device typically includes one or more replaceable units that have a shorter lifespan than the image forming device. In some instances, a replaceable unit may include two or more modules (e.g., a toner supply portion, a developer unit, a photoconductor unit, etc.) fixed to each other such that the two or more modules are installable into and removable from the image forming device as a single replaceable unit. It is important for proper operation that the replaceable unit(s) are precisely aligned within the image forming device and that each module is precisely aligned with respect to other modules. Misalignment may cause toner leakage or print quality defects.

Each replaceable unit may include one or more imaging components, such as a photoconductive drum, a charge roll, a developer roll, a toner adder roll, etc., that require electrical voltage from a power supply in the image forming device in order to electrostatically move toner from one component to another. Accordingly, the replaceable unit(s) may include one or more electrical contacts that mate with corresponding electrical contacts in the image forming device upon installation of the replaceable unit in the image forming device in order to provide an electrical connection between the power supply of the image forming device and the replaceable unit. Electrical connections between modules of the replaceable unit may be required in order to carry voltage from the electrical contacts of the replaceable unit to the imaging components.

SUMMARY

A replaceable unit for use in an electrophotographic image forming device according to one example embodiment includes a photoconductor unit having a rotatable photoconductive drum and a developer unit having a rotatable developer roll that is positioned to supply toner to the photoconductive drum. The developer unit is attached to the photoconductor unit in a manner that permits movement of the developer unit relative to the photoconductor unit. An electrical contact is positioned to contact a corresponding electrical contact in the image forming device when the replaceable unit is installed in the image forming device. A spring mechanically biases the developer unit relative to the photoconductor unit applying a bias force on the developer roll toward the photoconductive drum. The spring is electrically conductive and forms a portion of an electrical path from the electrical contact of the replaceable unit to an imaging component of the replaceable unit for carrying voltage from the electrical contact of the replaceable unit to the imaging component of the replaceable unit.

In some embodiments, the developer unit is pivotable relative to the photoconductor unit.

Embodiments include those wherein the spring is an extension spring. In some embodiments, at least one of a first end and a second end of the extension spring contacts a hemmed segment on a corresponding electrically conductive anchor on the photoconductor unit or developer unit. The hemmed segment includes a folded portion of an electrically conductive material of the anchor.

Embodiments include those wherein the imaging component of the replaceable unit is an imaging component of the developer unit. In some embodiments, the electrical contact of the replaceable unit is positioned on the photoconductor unit. In some embodiments, the imaging component of the developer unit is the developer roll. In some embodiments, the imaging component of the developer unit is a rotatable toner adder roll positioned to supply toner to the developer roll.

A replaceable unit for use in an electrophotographic image forming device according to another example embodiment includes a photoconductor unit having a rotatable photoconductive drum and a developer unit having a rotatable developer roll that is positioned to supply toner to the photoconductive drum. The developer unit is pivotable relative to the photoconductor unit about a pivot axis. An electrical contact on the photoconductor unit is positioned to contact a corresponding electrical contact in the image forming device when the replaceable unit is installed in the image forming device. A spring is positioned to mechanically bias the developer unit about the pivot axis relative to the photoconductor unit to apply a bias force on the developer roll toward the photoconductive drum. The spring is electrically conductive and forms a portion of an electrical path from the electrical contact on the photoconductor unit to an imaging component of the developer unit for carrying voltage from the electrical contact on the photoconductor unit to the imaging component of the developer unit.

A toner cartridge according to one example embodiment includes a housing having a top, a bottom, a first side and a second side positioned between a first longitudinal end and a second longitudinal end of the housing. The housing has a reservoir for holding toner. A longitudinal dimension of the housing runs from the first longitudinal end to the second longitudinal end. A photoconductor unit is positioned along the first side of the housing and has a rotatable photoconductive drum. A portion of an outer surface of the photoconductive drum is positioned along the bottom of the housing. A developer unit is positioned along the second side of the housing and has a rotatable developer roll. The developer roll is positioned to supply toner from the reservoir to the photoconductive drum. The developer unit is pivotable relative to the photoconductor unit about a pivot axis. An electrical contact on the first longitudinal end of the housing is positioned to contact a corresponding electrical contact in an image forming device when the toner cartridge is installed in the image forming device. The electrical contact of the toner cartridge is positioned on the photoconductor unit. An extension spring has a first end connected to the photoconductor unit and a second end connected to the developer unit such that the extension spring is positioned to mechanically bias the developer unit about the pivot axis relative to the photoconductor unit to apply a bias force on the developer roll toward the photoconductive drum. The extension spring is electrically conductive and forms a portion of an electrical path from the electrical contact of the toner cartridge to the developer roll for carrying voltage from the electrical contact of the toner cartridge to the developer roll.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
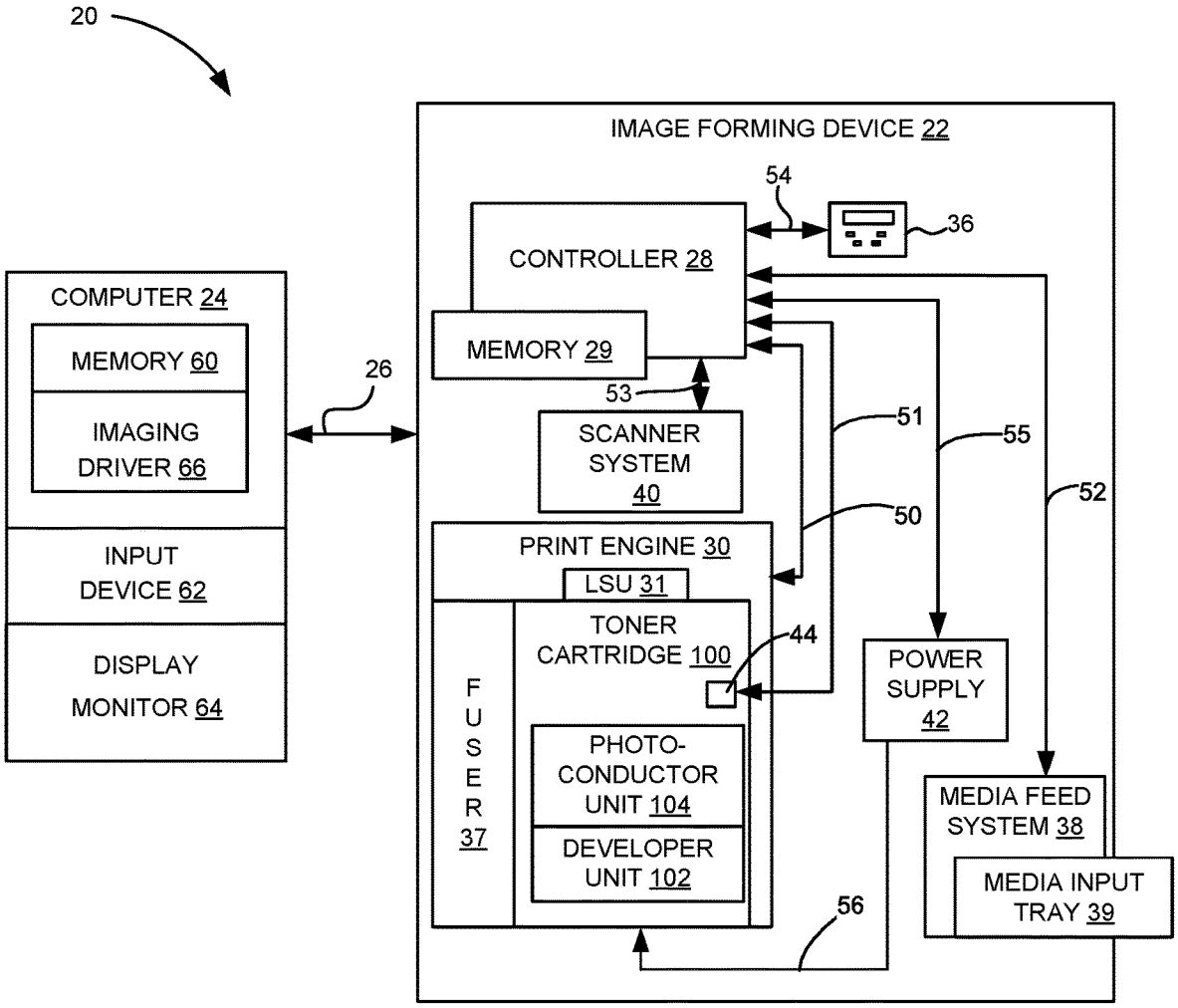
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with media feed system 38 via a communications link 52. Controller 28 communicates with scanner system 40 via a communications link 53. User interface 36 is communicatively coupled to controller 28 via a communications link 54. Controller 28 communicates with power supply 42 via a communications link 55. Controller 28 processes print and scan data and operates print engine 30 during printing and scanner system 40 during scanning. Processing circuitry 44 may provide authentication functions, safety and operational interlocks, operating parameters and usage information related to toner cartridge 100. Processing circuitry 44 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100 and a fuser 37, all mounted within image forming device 22. Toner cartridge 100 is removably mounted in image forming device 22. Power supply 42 provides an electrical voltage to various components of toner cartridge 100 via an electrical path 56. Toner cartridge 100 includes a developer unit 102 that houses a toner reservoir and a toner development system. In the example embodiment illustrated, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. Toner cartridge 100 also includes a photoconductor unit 104 that houses a charge roll, a photoconductive drum and a waste toner removal system. Although the example image forming device 22 illustrated in FIG. 1 includes one toner cartridge, in the case of an image forming device configured to print in color, separate toner cartridges may be used for each toner color. For example, in one embodiment, the image forming device includes four toner cartridges, each toner cartridge containing a particular toner color (e.g., black, cyan, yellow and magenta) to permit color printing.

Figure 2:
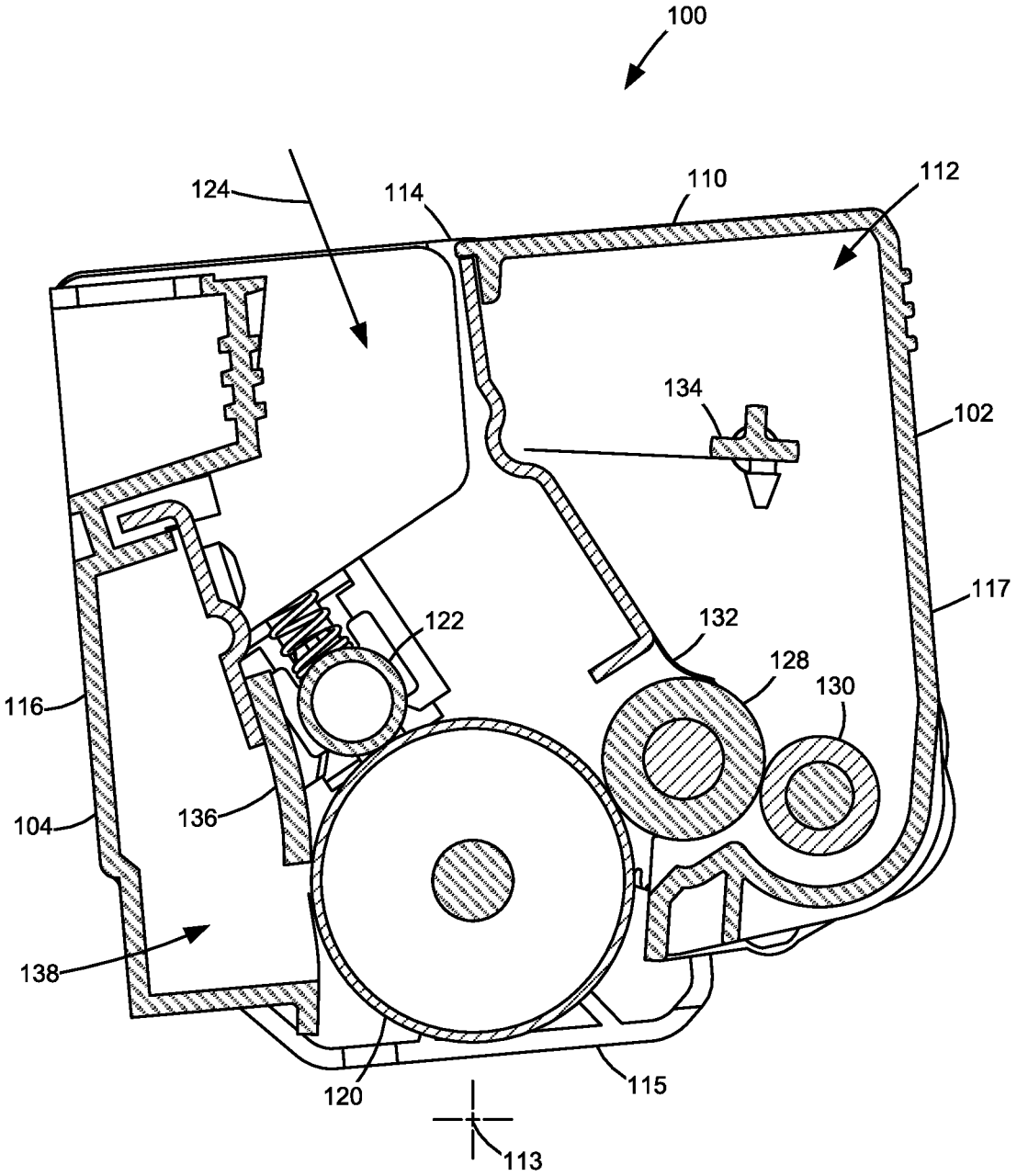
FIG. 2 is a cross-sectional view of a toner cartridge of the imaging system according to one example embodiment.

FIG. 2 shows toner cartridge 100 according to one example embodiment. Toner cartridge 100 includes an elongated housing 110 that includes walls forming a toner reservoir 112. In the example embodiment illustrated, housing 110 extends along a longitudinal dimension 113 and includes a top 114, a bottom 115, a side 116 and a side 117 that extend between longitudinal ends 118, 119 (FIGS. 3 and 4) of housing 110. In this embodiment, developer unit 102 is positioned along side 117 of housing 110 and photoconductor unit 104 is positioned along side 116 of housing 110.

The electrophotographic printing process is well known in the art and, therefore, is described briefly herein. During a print operation, a rotatable charge roll 122 of photoconductor unit 104 charges the surface of a rotatable photoconductive drum 120. The charged surface of photoconductive drum 120 is then selectively exposed to a laser light source 124 from LSU 31 through a slit 126 (FIG. 4) in the top 114 of housing 110 to form an electrostatic latent image on photoconductive drum 120 corresponding to the image to be printed. Charged toner from developer unit 102 is picked up by the latent image on photoconductive drum 120 creating a toned image on the surface of photoconductive drum 120. Charge roll 122 and photoconductive drum 120 are each electrically charged to a respective predetermined voltage by power supply 42 in order to achieve a desired voltage differential between the charged portions of the surface of photoconductive drum 120 and the portions of the surface of photoconductive drum 120 discharged by laser light source 124.

Developer unit 102 includes toner reservoir 112 having toner stored therein and a rotatable developer roll 128 that supplies toner from toner reservoir 112 to photoconductive drum 120. In the example embodiment illustrated, a rotatable toner adder roll 130 in developer unit 102 supplies toner from toner reservoir 112 to developer roll 128. A doctor blade 132 disposed along developer roll 128 provides a substantially uniform layer of toner on developer roll 128 for transfer to photoconductive drum 120. As developer roll 128 and photoconductive drum 120 rotate, toner particles are electrostatically transferred from developer roll 128 to the latent image on photoconductive drum 120 forming a toned image on the surface of photoconductive drum 120. In one embodiment, developer roll 128 and photoconductive drum 120 rotate in opposite rotational directions such that their adjacent surfaces move in the same direction to facilitate the transfer of toner from developer roll 128 to photoconductive drum 120. One or more movable toner agitators 134 may be provided in toner reservoir 112 to distribute the toner therein and to break up any clumped toner. Developer roll 128 and toner adder roll 130 are each electrically charged to a respective predetermined voltage by power supply 42 in order to attract toner from reservoir 112 to toner adder roll 130 and to electrostatically transfer toner from toner adder roll 130 to developer roll 128 and from developer roll 128 to the latent image on the surface of photoconductive drum 120. Doctor blade 132 may also be electrically charged to a predetermined voltage by power supply 42 as desired.

The toned image is then transferred from photoconductive drum 120 to the print media (e.g., paper) either directly by photoconductive drum 120 or indirectly by an intermediate transfer member. In the example embodiment illustrated, the surface of photoconductive drum 120 is exposed from housing 110 along the bottom 115 of housing 110 where the toned image transfers from photoconductive drum 120 to the print media or intermediate transfer member. Fuser 37 (FIG. 1) then fuses the toner to the print media. A cleaner blade 136 (or cleaner roll) of photoconductor unit 104 removes any residual toner adhering to photoconductive drum 120 after the toner is transferred from photoconductive drum 120 to the print media or intermediate transfer member. Waste toner from cleaner blade 136 may be held in a waste toner reservoir 138 in photoconductor unit 104 as illustrated or moved to a separate waste toner container. The cleaned surface of photoconductive drum 120 is then ready to be charged again and exposed to laser light source 124 to continue the printing cycle.

Figure 3:
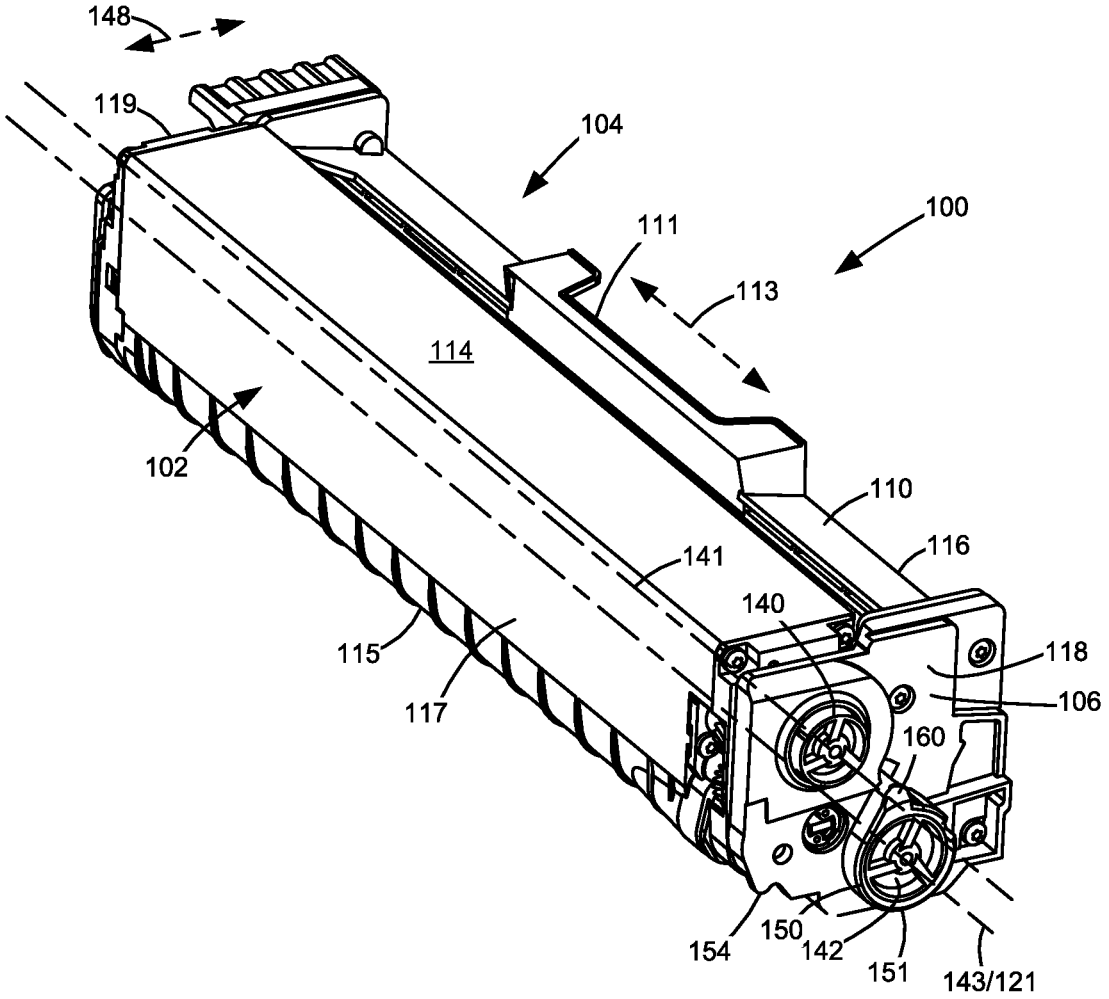
FIGS. 3 and 4 are perspective views of the toner cartridge according to one example embodiment.
Figure 4:
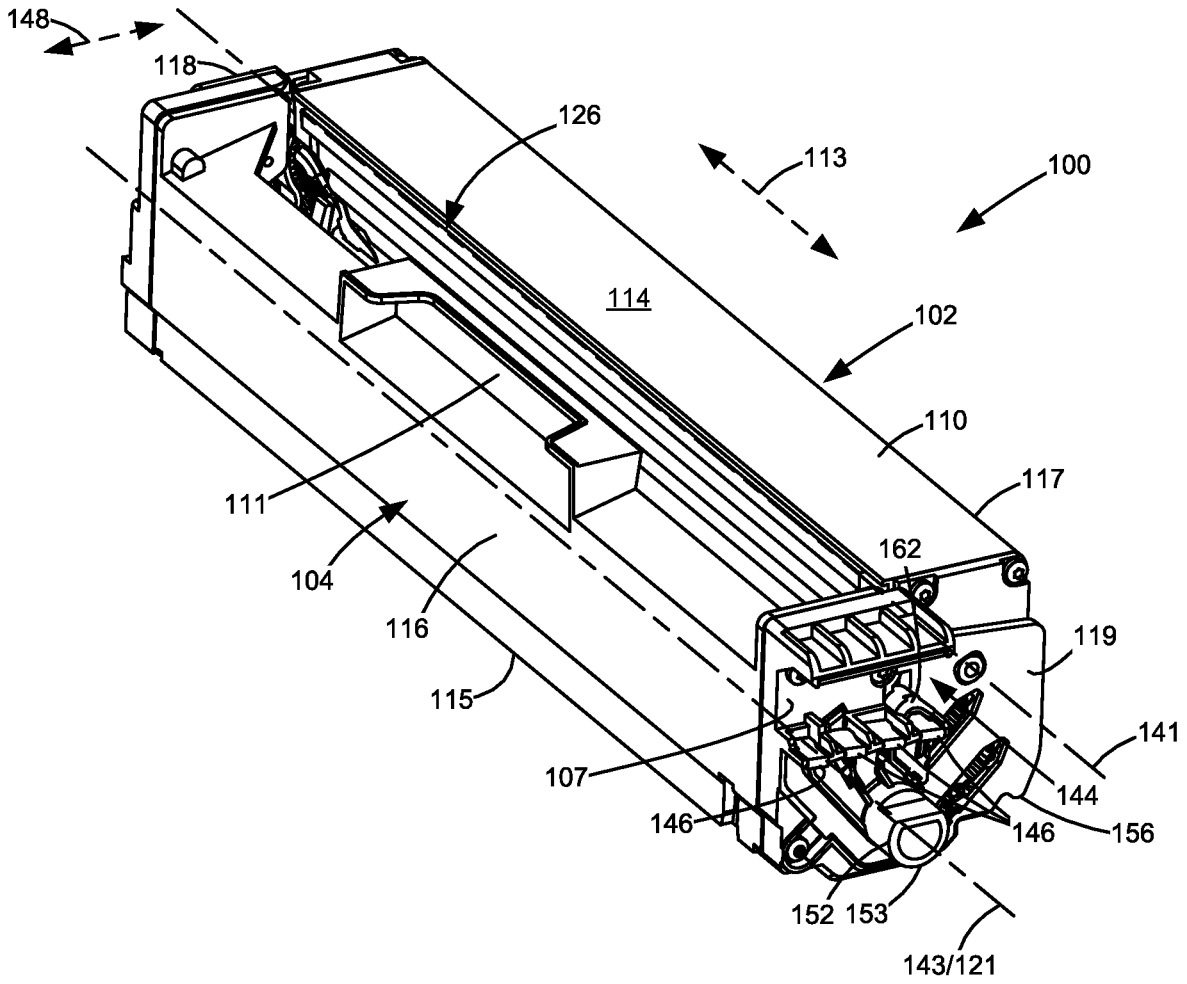
Figure 5:
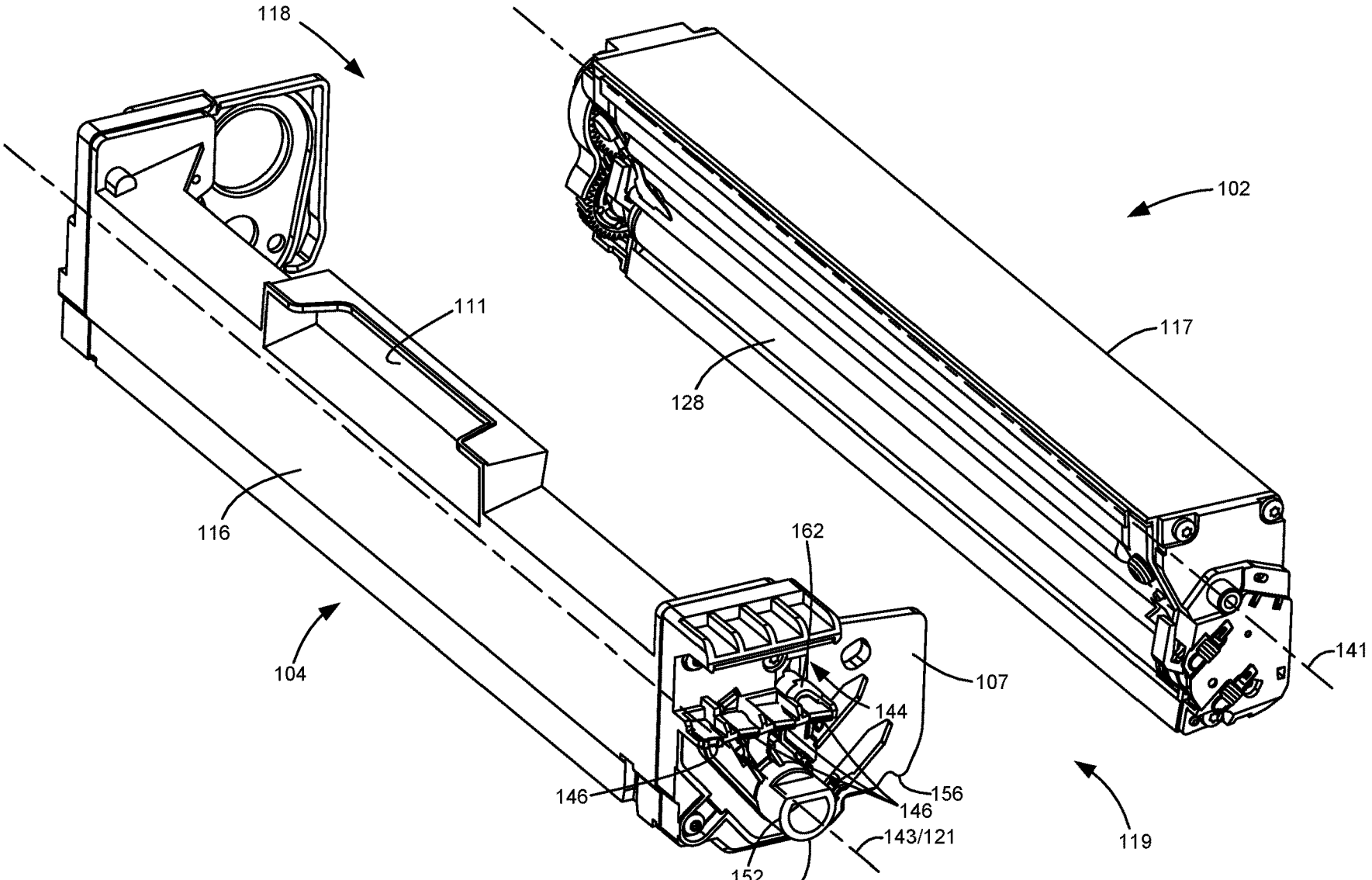
FIG. 5 is an exploded view of the toner cartridge shown in FIGS. 3 and 4 showing a developer unit and a photoconductor unit of the toner cartridge according to one example embodiment.

FIGS. 3-5 show the exterior of toner cartridge 100 according to one example embodiment. As shown, in this embodiment, developer unit 102 is positioned at side 117 of housing 110 and photoconductor unit 104 is positioned at side 116 of housing 110. FIG. 5 shows developer unit 102 separated from photoconductor unit 104 with developer roll 128 exposed on developer unit 102 for mating with photoconductive drum 120. In the example embodiment illustrated, toner cartridge 100 includes a handle 111 positioned along side 116 and/or top 114 of housing 110 to assist the user with handling toner cartridge 100.

Figure 6:
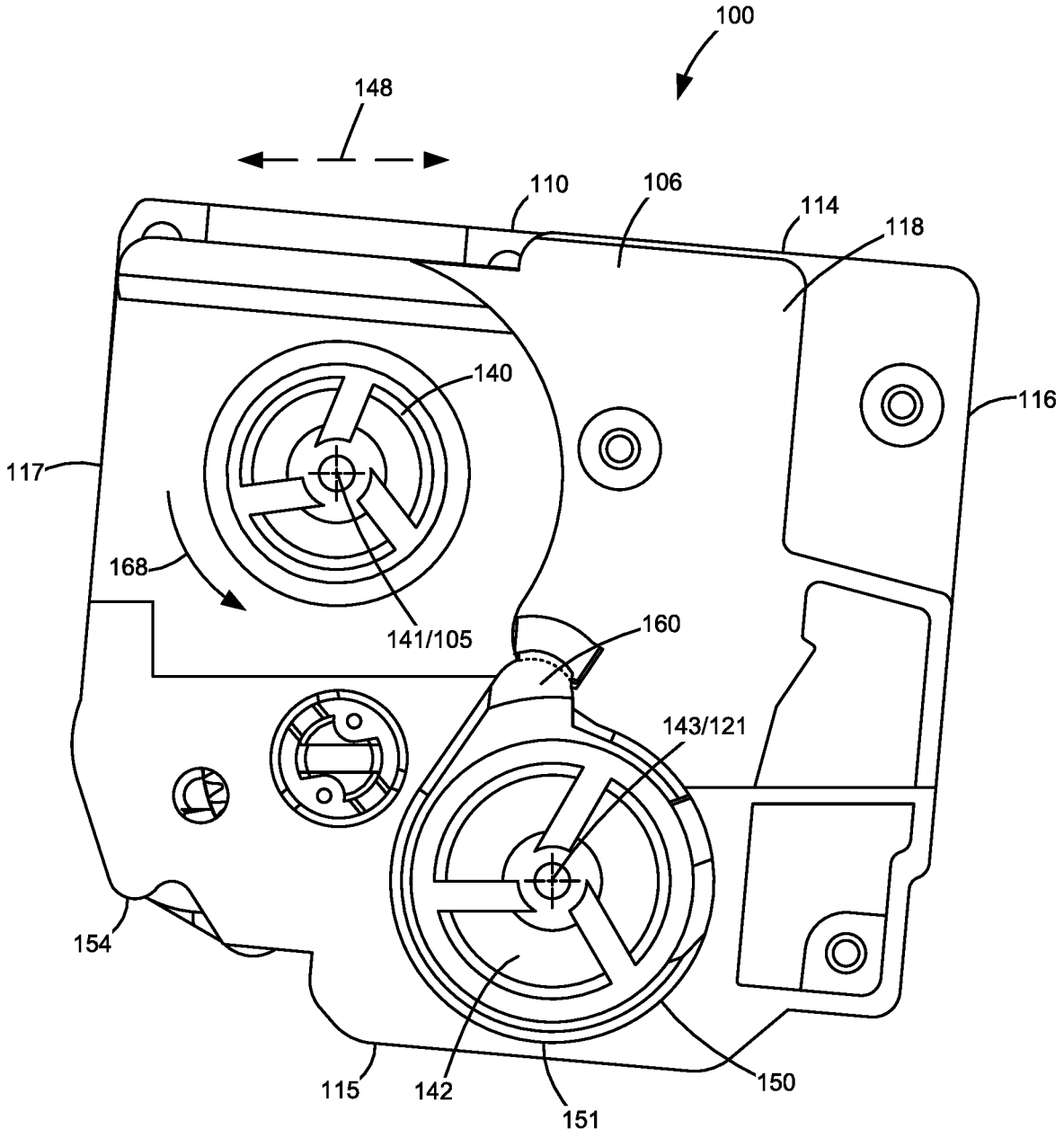
FIG. 6 is a first side elevation view of the toner cartridge of FIGS. 3-5 according to one example embodiment.

With reference to FIGS. 3 and 6, in the example embodiment illustrated, a pair of drive couplers 140, 142 are exposed on an outer portion of housing 110 in position to receive rotational force from a corresponding drive system in image forming device 22 when toner cartridge 100 is installed in image forming device 22 to drive rotatable components of developer unit 102 and photoconductive drum 120, respectively. The drive system in image forming device 22 includes one or more drive motors and a drive transmission from the drive motor(s) to a pair of drive couplers that mate with drive couplers 140, 142 of toner cartridge 100 when toner cartridge 100 is installed in image forming device 22. In the example embodiment illustrated, drive couplers 140, 142 are each exposed on end 118 of housing 110. In the embodiment illustrated, drive couplers 140, 142 are exposed on an end cap 106 of photoconductor unit 104. Each drive coupler 140, 142 includes a rotational axis 141, 143. In the example embodiment illustrated, drive couplers 140, 142 are each configured to mate with and receive rotational motion from the corresponding drive couplers in image forming device 22 at the axial ends of drive couplers 140, 142. Drive coupler 140 is operatively connected (either directly or indirectly through one or more intermediate gears) to rotatable components of developer unit 102 including, for example, developer roll 128, toner adder roll 130 and toner agitator 134, to rotate developer roll 128, toner adder roll 130 and toner agitator 134 upon receiving rotational force from the corresponding drive system in image forming device 22. Drive coupler 142 is operatively connected (either directly as in the embodiment illustrated or indirectly through one or more intermediate gears) to photoconductive drum 120 to rotate photoconductive drum 120 upon receiving rotational force from the corresponding drive system in image forming device 22. In some embodiments, charge roll 122 is driven by friction contact between the surfaces of charge roll 122 and photoconductive drum 120. In other embodiments, charge roll 122 is connected to drive coupler 142 by one or more gears.

Figure 7:
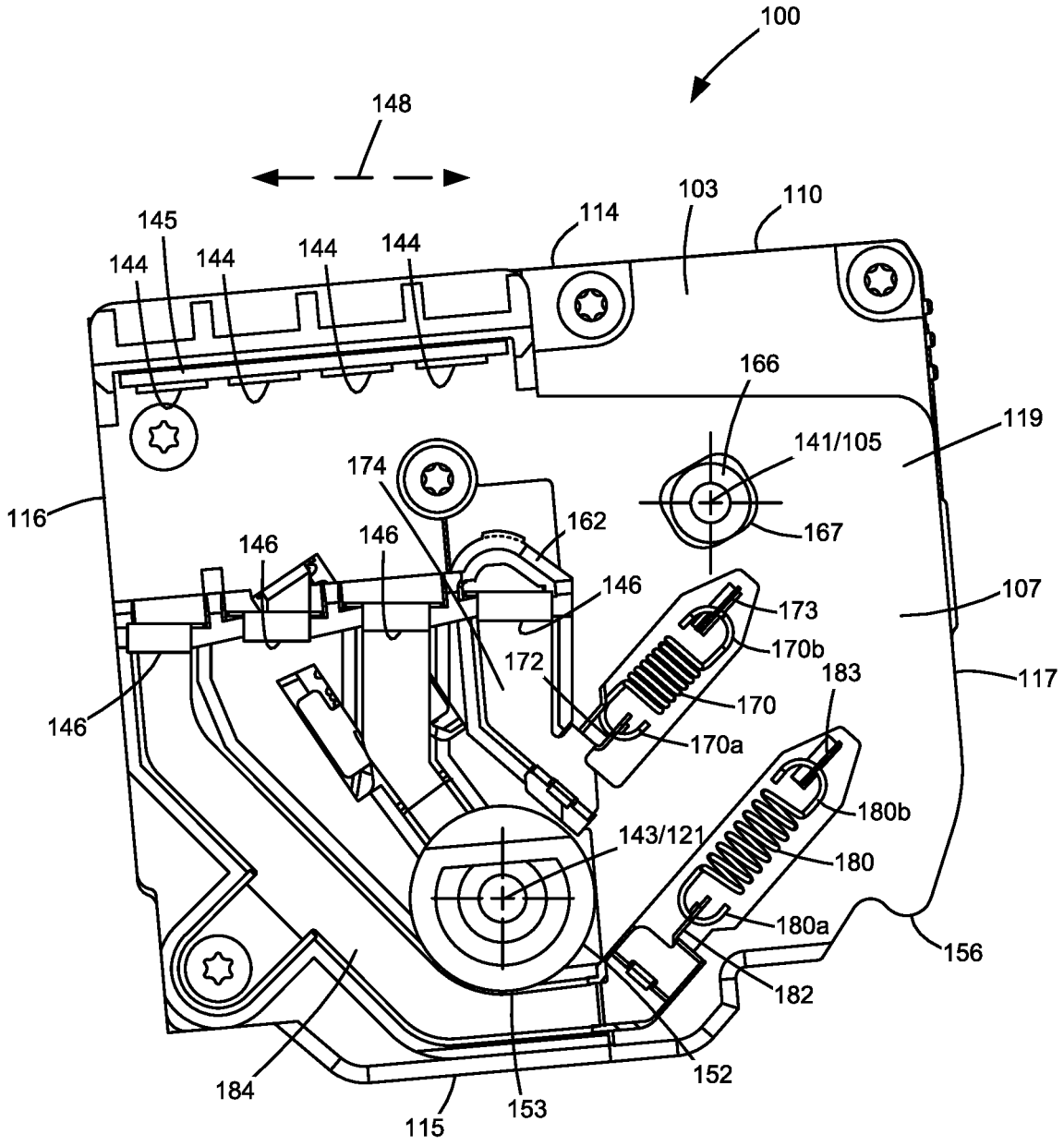
FIG. 7 is a second side elevation view of the toner cartridge of FIGS. 3-6 according to one example embodiment.

With reference to FIGS. 4 and 7, in the example embodiment illustrated, toner cartridge 100 includes one or more electrical contacts 144 positioned on end 119 of housing 110 and electrically connected to processing circuitry 44 and one or more electrical contacts 146 positioned on end 119 of housing 110 and electrically connected to one or more imaging components of toner cartridge 100. In the embodiment illustrated, electrical contacts 144, 146 are positioned on an end cap 107 of photoconductor unit 104. Electrical contacts 144 and 146 are positioned to contact corresponding electrical contacts in image forming device 22 when toner cartridge 100 is installed in image forming device 22 in order to facilitate communications link 51 between processing circuitry 44 and controller 28 and electrical path 56 between the one or more imaging components of toner cartridge 100 and power supply 42. In the example embodiment illustrated, electrical contacts 144 are positioned on a printed circuit board 145 that is mounted to housing 110 and that includes processing circuitry 44 thereon. In another embodiment, processing circuitry 44 is positioned elsewhere on housing 110 and is electrically connected to electrical contacts 144, for example, by suitable traces or cabling. In the example embodiment illustrated, electrical contacts 146 include discrete electrical contacts each electrically connected to one of photoconductive drum 120, charge roll 122, developer roll 128 and toner adder roll 130.

Electrical contacts 144 and 146 are unobstructed on end 119 of housing 110 permitting electrical contacts 144 and 146 to mate with corresponding electrical contacts in image forming device 22 upon installation of toner cartridge 100 into image forming device 22. In the example embodiment illustrated, electrical contacts 144 and 146 are each exposed and unobstructed from below (in a direction from bottom 115 to top 114 of housing 110) permitting the corresponding electrical contacts in image forming device 22 to contact electrical contacts 144 and 146 from below upon installation of toner cartridge 100 into image forming device 22. In the example embodiment illustrated, electrical contacts 144 are positioned higher than electrical contacts 146, such as directly above electrical contacts 146 as shown. In this embodiment, electrical contacts 144 and 146 extend outward, away from end 119, along an axial dimension of photoconductive drum 120. In the example embodiment illustrated, electrical contacts 144 are positioned adjacent to the top 114 of housing 110, higher than rotational axes 141, 143 of drive couplers 140, 142 and higher than rotational axis 121 of photoconductive drum 120. In this embodiment, electrical contacts 146 are positioned approximately midway up end 119 of housing 110, higher than rotational axis 143 of drive coupler 142 and higher than rotational axis 121 of photoconductive drum 120, but lower than rotational axis 141 of drive coupler 140. In the example embodiment illustrated, electrical contacts 144 and 146 are positioned adjacent to side 116 of housing 110. Electrical contacts 144 are aligned with electrical contacts 146 along a lateral dimension 148 of housing 110 that runs from side 116 to side 117, orthogonal to longitudinal dimension 113, such that electrical contacts 144 overlap with electrical contacts 146 along lateral dimension 148. Electrical contacts 144, 146 are spaced toward side 116 of housing 110 from rotational axis 141 of drive coupler 140, which is positioned closer to side 117 of housing 110 than to side 116 of housing 110 in the embodiment illustrated.

With reference to FIGS. 3-7, in the example embodiment illustrated, toner cartridge 100 includes a pair of positioning bosses 150, 152 that each protrude outward away from a respective end 118, 119 of housing 110 at and along a rotational axis 121 of photoconductive drum 120. Boss 150 is positioned on end 118 of housing 110 and at least partially encircles drive coupler 142. Boss 152 is positioned on end 119 of housing 110 at rotational axes 121 and 143 of photoconductive drum 120 and drive coupler 142. Each boss 150, 152 is unobstructed from below permitting the boss 150, 152 to contact and sit in a corresponding V-block in image forming device 22 in order to define a vertical position of toner cartridge 100 and a horizontal position of toner cartridge 100 along lateral dimension 148. In the example embodiment illustrated, a bottom portion of each boss 150, 152 includes a rounded bottom surface 151, 153, e.g., formed along an arc of a circle, that contacts and sits in the corresponding V-block in image forming device 22. In the embodiment illustrated, each boss 150, 152 is formed integrally with a respective end cap 106, 107 of photoconductor unit 104.

In the example embodiment illustrated, toner cartridge 100 includes a pair of rotational stops 154, 156 that prevent rotation of toner cartridge 100 about an axis parallel to longitudinal dimension 113 of housing 110 when toner cartridge 100 is installed in image forming device 22. Each rotational stop 154, 156 is positioned along the bottom 115 of housing 110 at side 117 of housing 110 at a respective end 118, 119 of housing 110. In the embodiment illustrated, rotational stops 154, 156 are formed by members, such as extensions or feet, that protrude downward from the bottom 115 of housing 110 at ends 118, 119 of housing 110. Each rotational stop 154, 156 is unobstructed from below permitting each rotational stop 154, 156 to contact a corresponding portion of a frame in image forming device 22 in order to define a rotational position of toner cartridge 100. In the embodiment illustrated, each rotational stop 154, 156 is formed integrally with a respective end cap 106, 107 of photoconductor unit 104.

Toner cartridge 100 also includes a pair of hold-down engagement members 160, 162 that each contact a corresponding hold-down in image forming device 22 and receive a corresponding bias force to maintain contact between bosses 150, 152 of toner cartridge 100 and the corresponding V-blocks in image forming device 22 and between rotational stops 154, 156 of toner cartridge 100 and the corresponding portions of the frame in image forming device 22 during operation of toner cartridge 100 in image forming device 22. Engagement member 160 is positioned on end 118 and engagement member 162 is positioned on end 119. Each engagement member 160, 162 is unobstructed from above permitting the corresponding hold-downs in image forming device 22 to contact engagement members 160, 162 from above in order to apply a downward force on engagement members 160, 162, including, for example, a primarily downward force on engagement members 160, 162. In the embodiment illustrated, each engagement member 160, 162 is formed integrally with a respective end cap 106, 107 of photoconductor unit 104.

In the example embodiment illustrated, the positioning features of toner cartridge 100 (e.g., bosses 150, 152, rotational stops 154, 156 and engagement members 160, 162) that physically locate toner cartridge 100 vertically, horizontally along lateral dimension 148 and rotationally relative to image forming device 22 when toner cartridge 100 is installed in image forming device 22 are positioned on photoconductor unit 104 of toner cartridge 100. In this embodiment, various interface features of toner cartridge 100 (e.g., drive coupler 142 and electrical contacts 144, 146) that mate with corresponding features in image forming device 22 when toner cartridge 100 is installed in image forming device 22 are also positioned on photoconductor unit 104 of toner cartridge 100. The placement of the positioning and interface features of toner cartridge 100 on photoconductive drum 104 (e.g., instead of on developer unit 102) reduces the tolerance stack-up between the various positioning and interface features of toner cartridge 100 and photoconductive drum 120 in order to reduce the occurrence of print defects caused by misalignment of photoconductive drum 120 relative to the print media or intermediate transfer member that receives the toned image from photoconductive drum 120.

Figure 8:
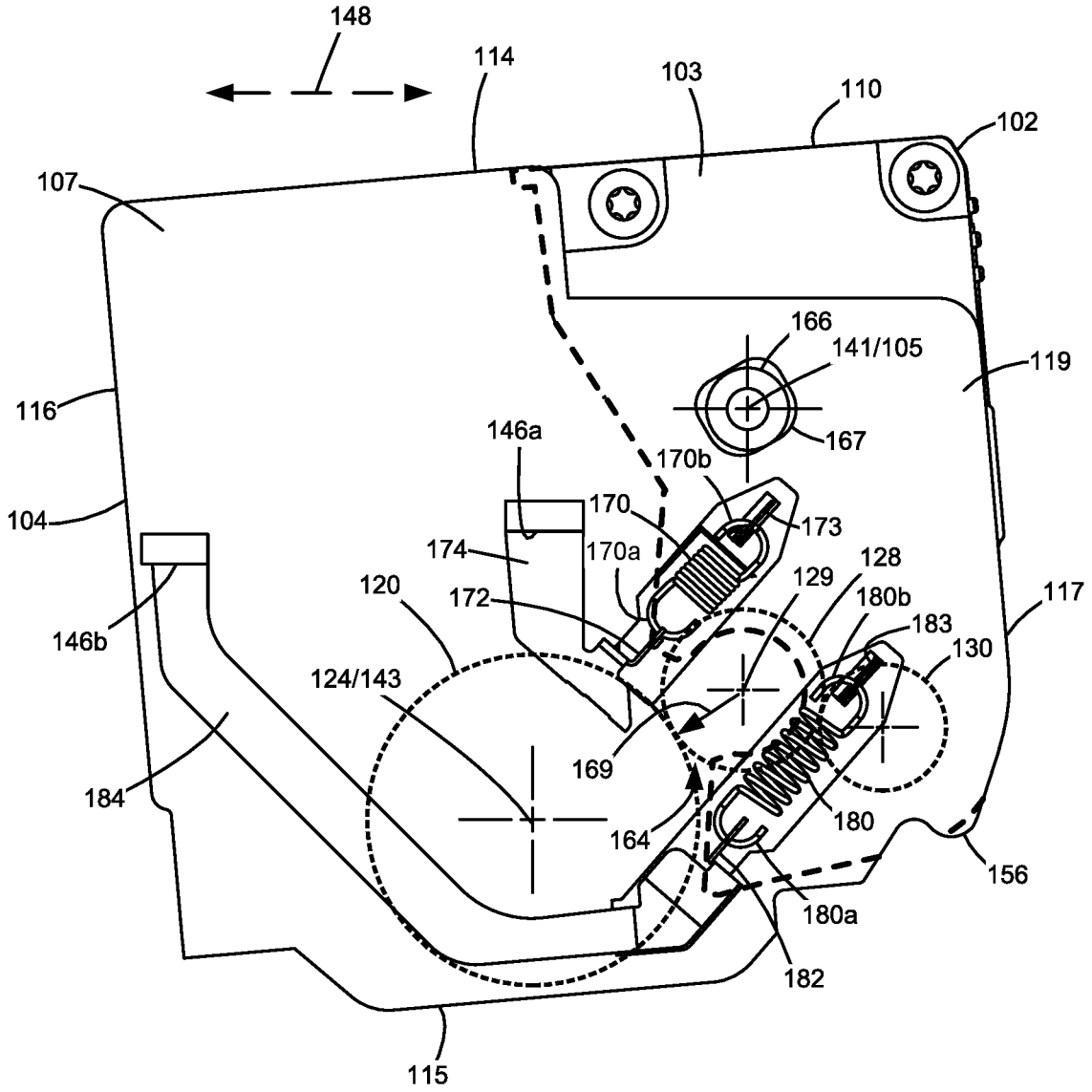
FIG. 8 is a schematic side elevation view of the toner cartridge of FIGS. 3-7 illustrating the relative positioning of various components of the toner cartridge according to one example embodiment.

FIG. 8 is a schematic elevation view of end 119 of toner cartridge 100 showing the positions of the outer surfaces of photoconductive drum 120, developer roll 128 and toner adder roll 130 in dashed line in order to illustrate the relative positions of these components. FIG. 8 also shows the portions of the outline of developer unit 102 obscured by end cap 107 of photoconductor unit 104 in dashed line in order to illustrate the relative positions of developer unit 102 and photoconductor unit 104.

With reference to FIGS. 6-8, developer unit 102 is positionally referenced to photoconductor unit 104 and is movable relative to the photoconductor unit 104 with developer roll 128 mechanically biased into compliance with photoconductive drum 120 in order to form a nip 164 between developer roll 128 and photoconductive drum 120 at a desired nip force for the transfer of toner from developer roll 128 to photoconductive drum 120. In the embodiment illustrated, developer unit 102 is pivotable relative to photoconductor unit 104 about a pivot axis 105. In the embodiment illustrated, pivot axis 105 is defined at end 118 of housing 110 by the position of rotational axis 141 of drive coupler 140 and is defined at end 119 of housing 110 by a post-slot interface on end 119 of housing 110 such that pivot axis 105 is nominally coaxial with rotational axis 141 of drive coupler 140. In this embodiment, developer unit 102 includes a post 166 that is received by a slot 167 on end cap 107 of photoconductor unit 104, but this configuration may be reversed as desired. In the embodiment illustrated, slot 167 is elongated to permit post 166 to translate to a small degree along a line parallel to an imaginary line that runs from rotational axis 121 of photoconductive drum 120 to a rotational axis 129 of developer roll 128 in order to account for slight variations in component dimensions.

As shown in FIG. 6, at end 118 of housing 110, the rotational motion of drive coupler 140 when drive coupler 140 is driven in an operative rotational direction 168 by the corresponding drive system in image forming device 22 applies a moment on developer unit 102 in a counterclockwise direction about pivot axis 105 as viewed in FIG. 6 to urge developer roll 128 into compliance with photoconductive drum 120. As shown in FIGS. 7 and 8, one or more bias springs, such as, for example, a pair of bias springs 170, 180, are positioned at end 119 of housing 110 and combine to provide a bias force 169 on developer unit 102 in a clockwise direction about pivot axis 105 as viewed in FIGS. 7 and 8 to urge developer roll 128 into compliance with photoconductive drum 120. In the example embodiment illustrated, each bias spring 170, 180 is an extension spring that extends from a first anchor 172, 182 positioned on photoconductor unit 104 to a second anchor 173, 183 positioned on developer unit 102.

In addition to mechanically biasing developer unit 102 relative to photoconductor unit 104, each bias spring 170, 180 is electrically conductive and forms an electrical path from a respective electrical contact 146 on photoconductor unit 104 to one or more respective imaging components of developer unit 102 in order to carry voltage received by electrical contacts 146 from power supply 42 in image forming device 22 to imaging components of developer unit 102. Specifically, in the embodiment illustrated, a first end 170*a* of bias spring 170 is connected to anchor 172 formed on (or connected to) an electrical trace 174 that runs from an electrical contact 146*a* of the set of electrical contacts 146 to anchor 172. A second end 170*b* of bias spring 170 is connected to anchor 173, which is electrically connected to one or more imaging components of developer unit 102, such as, for example, developer roll 128 permitting bias spring 170 to carry voltage from electrical contact 146*a* to developer roll 128. Similarly, in this embodiment, a first end 180*a* of bias spring 180 is connected to anchor 182 formed on (or connected to) an electrical trace 184 that runs from an electrical contact 146*b* of the set of electrical contacts 146 to anchor 182. A second end 180*b* of bias spring 180 is connected to anchor 183, which is electrically connected to one or more imaging components of developer unit 102, such as, for example, toner adder roll 130 and doctor blade 132 permitting bias spring 180 to carry voltage from electrical contact 146*b* to toner adder roll 130 and doctor blade 132.

Figure 9:
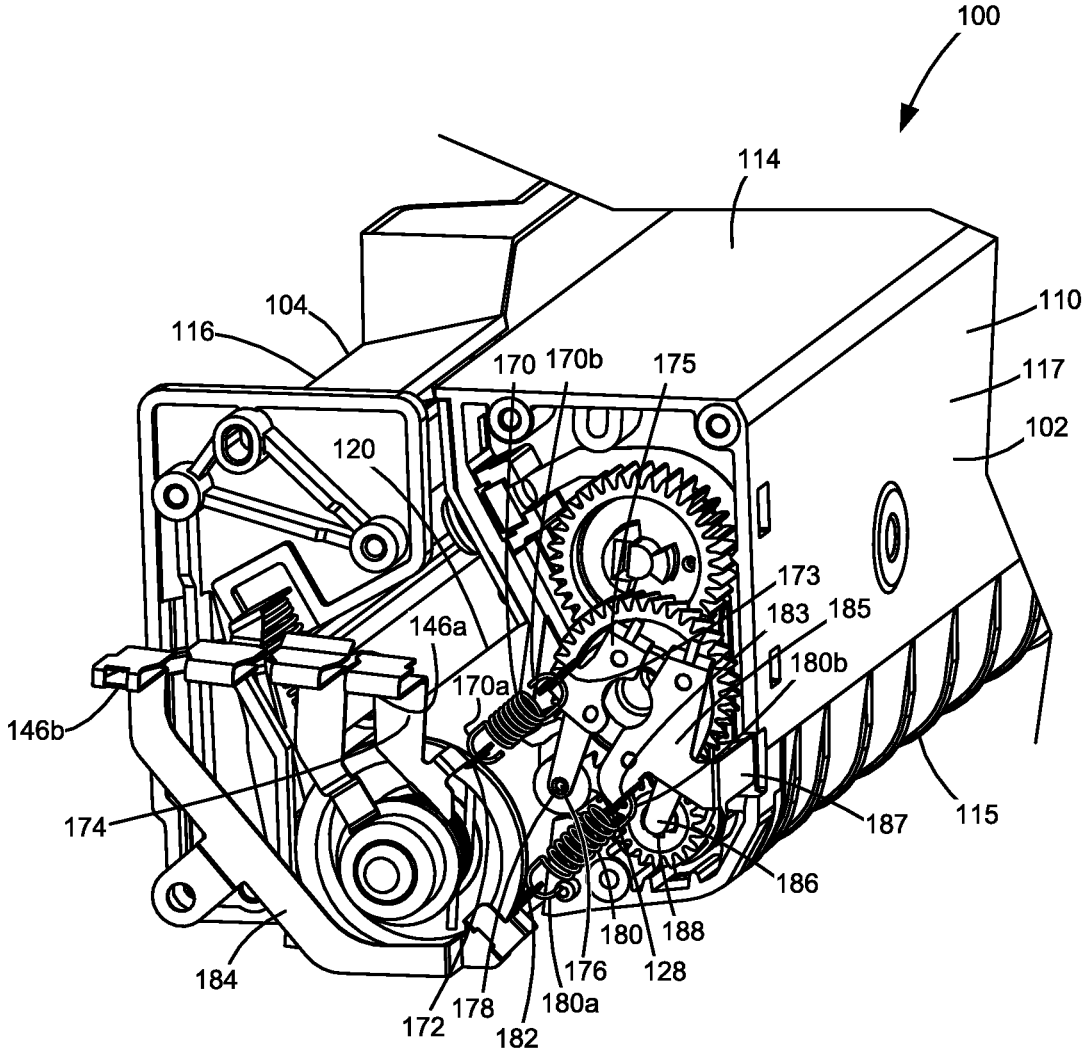
FIG. 9 is a perspective view of the toner cartridge of FIGS. 3-8 with end caps of the developer unit and the photoconductor unit omitted according to one example embodiment.

FIG. 9 shows toner cartridge 100 with end cap 107 of photoconductor 104 and an adjacent end cap 103 (FIGS. 7 and 8) of developer unit 102 omitted in order to more clearly illustrate the electrical paths from anchors 173 and 183 on developer unit 102 to the imaging components of developer unit 102 according to one example embodiment. In this embodiment, anchor 173 is formed on (or connected to) an electrical trace 175 that runs from anchor 173 to a terminal 176 that contacts the tip of a shaft 178 of developer roll 128 such that electrical trace 175 provides an electrical path from bias spring 170 to developer roll 128. Similarly, anchor 183 is formed on (or connected to) an electrical trace 185 that runs from anchor 183 to a terminal 186 that contacts the tip of a shaft 188 of toner adder roll 130 such that electrical trace 185 provides an electrical path from bias spring 180 to toner adder roll 130. In this embodiment, electrical trace 185 includes an additional terminal 187 that contacts a bracket that is electrically connected to doctor blade 132 in order to provide an electrical path from bias spring 180 to doctor blade 132. In this manner, in addition to mechanically biasing developer unit 102 relative to photoconductor unit 104, bias spring 170 provides an electrical path from electrical contact 146*a* on photoconductor unit 104 to developer roll 128 on developer unit 102 and bias spring 180 provides an electrical path from electrical contact 146*b* on photoconductor unit 104 to toner adder roll 130 and doctor blade 132 on developer unit 102.

Figure 10:
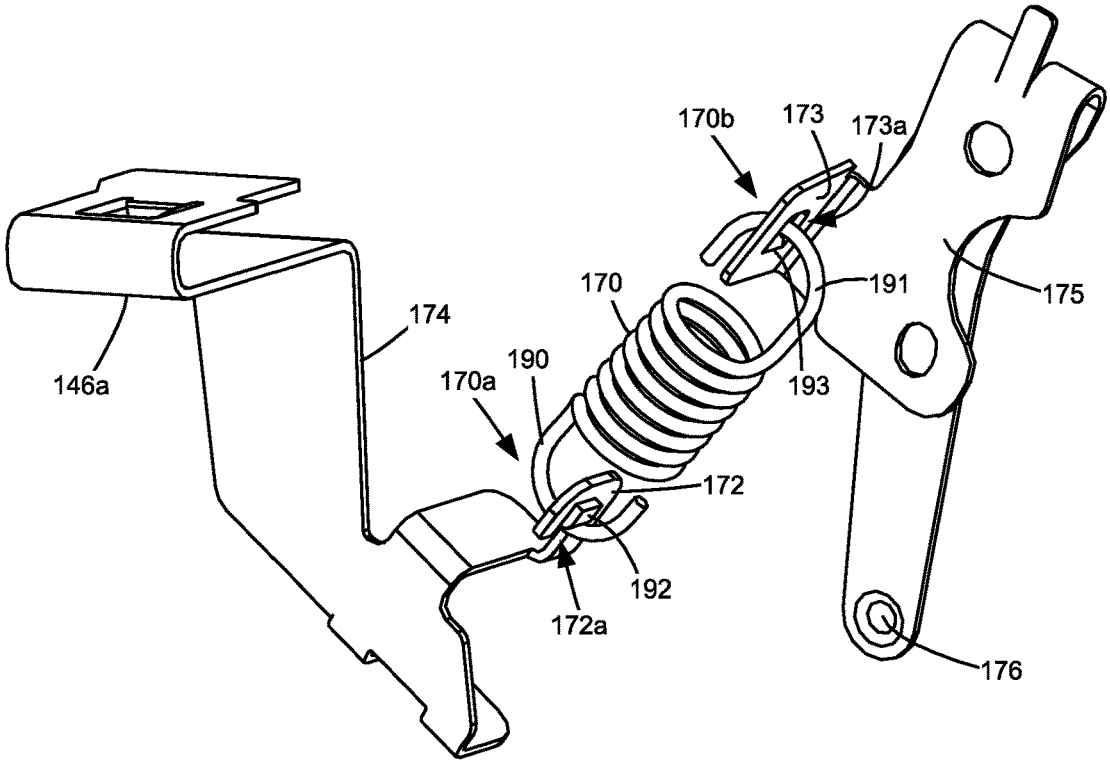
FIG. 10 is a perspective view of a bias spring of the toner cartridge connected to a pair of corresponding anchors according to one example embodiment.

FIG. 10 shows the connections of bias spring 170 to anchors 172 and 173 in greater detail. In this embodiment, each end 170*a*, 170*b* of bias spring 170 includes a respective hook 190, 191 formed thereon that passes through an opening 172*a*, 173*a* in the corresponding anchor 172, 173. Hooks 190, 191 of bias spring 170 contact hemmed segments 192, 193 on anchors 172, 173 such that the contact between hooks 190, 191 and hemmed segments 192, 193 pulls bias spring 170 taut.

Figure 11A:
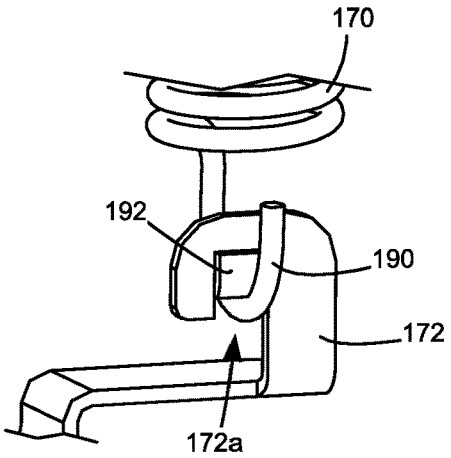
FIG. 11A is a perspective view of a first end of the bias spring of the toner cartridge connected to its corresponding anchor.
Figure 11B:
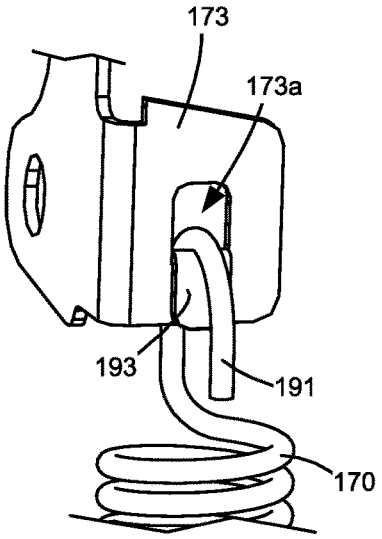
FIG. 11B is a perspective view of a second end of the bias spring of the toner cartridge connected to its corresponding anchor.

FIGS. 11A and 11B show anchors 172, 173 including hemmed segments 192, 193 in greater detail. Each hemmed segment 192, 193 is formed by folding or turning under a portion of the electrically conductive material of anchors 172, 173 permitting hooks 190, 191 to contact anchors 172, 173 at the folds. Hemmed segments 192, 193 provide a less abrasive contact surface than cut or sheared surfaces in order to reduce fretting corrosion of anchors 172, 173 and bias spring 170 to maintain sufficient electrical contact between anchors 172, 173 and bias spring 170 over time. In the embodiment illustrated, anchors 182, 183 also include hemmed segments (similar to hemmed segments 192, 193) that contact hooks (similar to hooks 190, 191) at the ends 180*a*, 180*b* of bias spring 180.

While the example embodiment illustrated includes a pair of bias springs 170, 180 that mechanically bias developer unit 102 relative to photoconductor unit 104 and that provide an electrical path from a respective electrical contact 146 on photoconductor unit 104 to one or more respective imaging components of developer unit 102, other embodiments may include more or fewer bias springs depending on the desired number of discrete electrical connections to developer unit 102 and the mechanical bias required. Similarly, while the example embodiment illustrated includes bias springs 170, 180 that mechanically bias developer unit 102 relative to photoconductor unit 104 and that provide an electrical path from a respective electrical contact 146 on photoconductor unit 104 to one or more respective imaging components of developer unit 102, in other embodiments, one or more bias springs of toner cartridge 100 may mechanically bias developer unit 102 relative to photoconductor unit 104 without providing an electrical path and/or one or more bias springs of toner cartridge 100 may provide an electrical path without mechanically biasing developer unit 102 relative to photoconductor unit 104. Further, while the example embodiment illustrated includes bias springs 170, 180 that provide electrical connections to developer roll 128, toner adder roll 130 and doctor blade 132, the bias springs may provide an electrical path to any suitable component of toner cartridge 100 as desired. Further, while the example embodiment illustrated includes bias springs 170, 180 in the form of extension springs, it will be appreciated that other spring configurations may be used as desired, such as, for example, one or more compression springs, torsion springs, leaf springs, etc. or combinations of different types of springs depending on the mechanical bias required. While the example embodiment illustrated includes bias springs 170, 180 in the form of extension springs positioned parallel to each other, bias springs 170, 180 may be positioned in other orientations relative to each other to urge developer roll 128 into compliance with photoconductive drum 120.

Further, while developer unit 102 is pivotable relative to photoconductor unit 104 about pivot axis 105 in the example embodiment illustrated, in other embodiments, developer unit 102 may have other positional relationships relative to photoconductor unit 104 as desired, such as, for example, being translatable relative to photoconductor unit 104.

Although the example embodiment illustrated includes a single replaceable unit in the form of toner cartridge 100 for each toner color, it will be appreciated that the replaceable unit(s) of the image forming device may employ any suitable configuration as desired. For example, in another embodiment, the main toner supply for the image forming device is provided in a first replaceable unit and the developer unit and photoconductor unit are provided in a second replaceable unit. Other configurations may be used as desired.

Further, it will be appreciated that the architecture and shape of toner cartridge 100 illustrated in FIGS. 2-5 is merely intended to serve as an example. Those skilled in the art understand that toner cartridges, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable unit for use in an electrophotographic image forming device, comprising:

a photoconductor unit having a rotatable photoconductive drum;

a developer unit having a rotatable developer roll that is positioned to supply toner to the photoconductive drum, the developer unit is attached to the photoconductor unit in a manner that permits movement of the developer unit relative to the photoconductor unit;

an electrical contact positioned to contact a corresponding electrical contact in the image forming device when the replaceable unit is installed in the image forming device; and a spring mechanically biasing the developer unit relative to the photoconductor unit applying a bias force on the developer roll toward the photoconductive drum, the spring is electrically conductive and forms a portion of an electrical path from the electrical contact of the replaceable unit to an imaging component of the replaceable unit for carrying voltage from the electrical contact of the replaceable unit to the imaging component of the replaceable unit.

2. The replaceable unit of claim 1, wherein the developer unit is pivotable relative to the photoconductor unit.

3. The replaceable unit of claim 1, wherein the spring is an extension spring.

4. The replaceable unit of claim 3, wherein at least one of a first end and a second end of the extension spring contacts a hemmed segment on a corresponding electrically conductive anchor on the photoconductor unit or developer unit, the hemmed segment includes a folded portion of an electrically conductive material of the anchor.

5. The replaceable unit of claim 1, wherein the imaging component of the replaceable unit is an imaging component of the developer unit.

6. The replaceable unit of claim 5, wherein the electrical contact of the replaceable unit is positioned on the photoconductor unit.

7. A replaceable unit for use in an electrophotographic image forming device, comprising:

a photoconductor unit having a rotatable photoconductive drum;

a developer unit having a rotatable developer roll that is positioned to supply toner to the photoconductive drum, the developer unit is pivotable relative to the photoconductor unit about a pivot axis;

an electrical contact on the photoconductor unit for contacting a corresponding electrical contact in the image forming device when the replaceable unit is installed in the image forming device; and a spring positioned to mechanically bias the developer unit about the pivot axis relative to the photoconductor unit to apply a bias force on the developer roll toward the photoconductive drum, the spring is electrically conductive and forms a portion of an electrical path from the electrical contact on the photoconductor unit to an imaging component of the developer unit for carrying voltage from the electrical contact on the photoconductor unit to the imaging component of the developer unit.

8. The replaceable unit of claim 7, wherein the spring is an extension spring.

9. The replaceable unit of claim 8, wherein at least one of a first end and a second end of the extension spring contacts a hemmed segment on a corresponding electrically conductive anchor on the photoconductor unit or developer unit, the hemmed segment includes a folded portion of an electrically conductive material of the anchor.

10. The replaceable unit of claim 7, wherein the imaging component of the developer unit is the developer roll.

11. The replaceable unit of claim 7, wherein the imaging component of the developer unit is a rotatable toner adder roll positioned to supply toner to the developer roll.

12. The replaceable unit of claim 7, further comprising:

a second electrical contact on the photoconductor unit for contacting a corresponding second electrical contact in the image forming device when the replaceable unit is installed in the image forming device; and a second spring positioned to mechanically bias the developer unit about the pivot axis relative to the photoconductor unit to apply the bias force on the developer roll toward the photoconductive drum, the second spring is electrically conductive and forms a portion of an electrical path from the second electrical contact on the photoconductor unit to a second imaging component of the developer unit for carrying voltage from the second electrical contact on the photoconductor unit to the second imaging component of the developer unit.

13. A toner cartridge, comprising:

a housing having a top, a bottom, a first side and a second side positioned between a first longitudinal end and a second longitudinal end of the housing, the housing has a reservoir for holding toner, a longitudinal dimension of the housing runs from the first longitudinal end to the second longitudinal end;

a photoconductor unit positioned along the first side of the housing and having a rotatable photoconductive drum, a portion of an outer surface of the photoconductive drum is positioned along the bottom of the housing;

a developer unit positioned along the second side of the housing and having a rotatable developer roll, the developer roll is positioned to supply toner from the reservoir to the photoconductive drum, the developer unit is pivotable relative to the photoconductor unit about a pivot axis;

an electrical contact on the first longitudinal end of the housing for contacting a corresponding electrical contact in an image forming device when the toner cartridge is installed in the image forming device, the electrical contact of the toner cartridge is positioned on the photoconductor unit; and an extension spring having a first end connected to the photoconductor unit and a second end connected to the developer unit such that the extension spring is positioned to mechanically bias the developer unit about the pivot axis relative to the photoconductor unit to apply a bias force on the developer roll toward the photoconductive drum, the extension spring is electrically conductive and forms a portion of an electrical path from the electrical contact of the toner cartridge to the developer roll for carrying voltage from the electrical contact of the toner cartridge to the developer roll.

14. The toner cartridge of claim 13, further comprising:

the developer unit having a rotatable toner adder roll positioned to supply toner from the reservoir to the developer roll;

a second electrical contact on the first longitudinal end of the housing for contacting a corresponding second electrical contact in the image forming device when the toner cartridge is installed in the image forming device, the second electrical contact of the toner cartridge is positioned on the photoconductor unit; and a second extension spring having a first end connected to the photoconductor unit and a second end connected to the developer unit such that the second extension spring is positioned to mechanically bias the developer unit about the pivot axis relative to the photoconductor unit to apply the bias force on the developer roll toward the photoconductive drum, the second extension spring is electrically conductive and forms a portion of an electrical path from the second electrical contact of the toner cartridge to the toner adder roll for carrying voltage from the second electrical contact of the toner cartridge to the toner adder roll.

15. The toner cartridge of claim 13, further comprising a drive coupler on the second longitudinal end of the housing for mating with a corresponding drive coupler in the image forming device for receiving rotational motion from the corresponding drive coupler in the image forming device when the toner cartridge is installed in the image forming device, the drive coupler of the toner cartridge is operatively connected to the developer roll to transfer rotational motion to the developer roll.

16. The toner cartridge of claim 15, wherein a rotational axis of the drive coupler is coaxial with the pivot axis of the developer unit.

17. The toner cartridge of claim 13, wherein at least one of the first end and the second end of the extension spring contacts a hemmed segment on a corresponding electrically conductive anchor on the photoconductor unit or developer unit, the hemmed segment includes a folded portion of an electrically conductive material of the anchor.

* * * * *